US006749691B2

(12) United States Patent
Misra et al.

(10) Patent No.: US 6,749,691 B2
(45) Date of Patent: Jun. 15, 2004

(54) METHODS OF CLEANING DISCOLORED METALLIC ARRAYS USING CHEMICAL COMPOSITIONS

(75) Inventors: Ashutosh Misra, Plano, TX (US); Matthew L. Fisher, Dallas, TX (US)

(73) Assignee: Air Liquide America, L.P., Houston, TX (US)

( * ) Notice: Subject to any disclaimer, the term of this patent is extended or adjusted under 35 U.S.C. 154(b) by 125 days.

(21) Appl. No.: 10/075,731

(22) Filed: Feb. 14, 2002

(65) Prior Publication Data

US 2002/0108633 A1 Aug. 15, 2002

Related U.S. Application Data

(60) Provisional application No. 60/268,667, filed on Feb. 14, 2001.

(51) Int. Cl.[7] ..... B08B 7/04

(52) U.S. Cl. ..... 134/3; 134/2; 134/19; 134/21; 134/26; 134/28; 134/29; 134/34; 134/36; 134/41; 134/42; 134/902

(58) Field of Search ..... 134/2, 3, 19, 21, 134/26, 28, 29, 34, 36, 41, 42, 902

(56) References Cited

U.S. PATENT DOCUMENTS 3,401,126 A 9/1968 Miller et al.
4,397,711 A * 8/1983 Donnelly et al. ..... 438/706
5,173,127 A * 12/1992 Shimakura et al. ..... 148/33.6
5,512,613 A 4/1996 Afzali-Ardakani et al.
5,532,094 A 7/1996 Arimura et al.
5,593,504 A 1/1997 Cala et al.
5,759,285 A 6/1998 Buchwalter et al.
5,821,208 A 10/1998 Cala et al.
5,846,387 A 12/1998 Hoffman et al.
5,910,010 A 6/1999 Nishizawa et al.
5,919,715 A * 7/1999 Tekeuchi et al. ..... 438/745
6,047,561 A 4/2000 Gary et al.
6,156,126 A * 12/2000 Chen et al. ..... 134/2
6,203,637 B1 3/2001 Dommann et al.
6,229,215 B1 5/2001 Egawa
6,250,318 B1 6/2001 Kiat et al.
2002/0108633 A1 * 8/2002 Misra et al. ..... 134/3

* cited by examiner

*Primary Examiner*—Sharidan Carrillo
(74) *Attorney, Agent, or Firm*—Linda K. Russell

(57) ABSTRACT

Methods of removing discoloration from a metal surface of an electronic device are presented the methods comprising the steps of exposing a metallic surface of an electronic device to a first composition comprising an organic reagent, the metallic surface having discoloration thereon, under conditions sufficient to form a first intermediate metallic surface substantially devoid of non-ionic residues; a second step of contacting the first intermediate metallic surface with a second composition comprising an acid under conditions sufficient to form a second intermediate metallic surface substantially devoid of non-ionic residues, oxides, hydroxides and the like; and rinsing the second intermediate metallic surface with deionized water.

12 Claims, 1 Drawing Sheet

(1 of 1 Drawing Sheet(s) Filed in Color)

METHODS OF CLEANING DISCOLORED METALLIC ARRAYS USING CHEMICAL COMPOSITIONS

CROSS REFERENCE TO RELATED APPLICATIONS

This application claims benefit of provisional application serial No. 60/268,667, filed Feb. 14, 2001, incorporated herein by reference.

BACKGROUND OF THE INVENTION

1. Field of the Invention

The invention is generally related to the field of cleaning metallic components. More specifically, the invention relates to cleaning metallic arrays, more particularly metallic arrays in electronic components such as integrated circuit flip-chip packages, and other packages.

2. Related Art

In the manufacture of integrated circuits and their various packages, residues are sometimes left from the manufacturing process on metallic components, or are generated prior to or during storage of the products. If the metallic components of the product have a residue from the manufacturing process, or contain residue generated after the manufacturing process while waiting for use, there exists the possibility that the metallic components of the product may not properly perform their intended functions.

Aside from performance, the appearance of the product may not be what is desired, or presumed by the user, due to instability of the product in the presence of the residue. For example, the electrical performance may not be a problem, but a discolored appearance may be enough for a customer to reject the product. Therefore, it has become imperative to find a way to clean discolored metallic arrays to remove residues that might have these deleterious effects.

As well stated in U.S. Pat. No. 5,759,285, a myriad of solder structures has been proposed for the interconnection of one electronic structure to another. Typical surface mount processes form the solder structures by screening solder paste on conductive, generally metallic pads exposed on the surface of a first electronic structure or substrate. A stencil printing operation is used to align the contact mask to the pads. The solder paste areas on the screened substrate are then aligned to corresponding pads on the electronic structure or board to be connected thereto. After alignment, the substrate and board go through a reflow operation to melt the solder paste and create a solder bond between the corresponding pads on the substrate and board.

The '285 patent describes other known interconnect technologies that use solder balls rather than a solder paste to provide the solder connecting structures. By using plated or evaporated solder balls, a more exact and somewhat greater quantity of solder can be applied than through screening. The solder balls are aligned and are held to a substrate and melted to form a solder joint on a conductive pad of the substrate. The use of solder ball connectors has been applied to the mounting of integrated circuit chips using the so-called C4 (control collapse chip connection) technology since the method and structure were first described and patented in U.S. Pat. Nos. 3,401,126 and 3,429,042. More recently, larger solder balls have been used in surface mount technology to attach single or multichip packages to circuit cards in so-called ball grid array or BGA technology. Regardless of the form of the solder connection or the method of making the solder connection, there are typically three stages at which cleaning of the solder surface may be essential. First, during deployment of the solder prior to making the connections, processing of solder may leave undesirable residues. For example, in evaporating or plating of solder balls for flip-chip (C4) connection or BGA module, photoresist or plating bath residues may be left which will interfere with proper solder wetting of the pads. Second, to maintain the alignment of the solder to the pads on the substrate or card and to allow good wetting of the solder on the pads, flux is most often used and will need to be removed to avoid leaving corrosive contaminants on the packaging assembly. Finally, rework of part-good assemblies requires special handling, which may require a cleaning step that assures the reliability of the package. For example, removal of a reworkable epoxy underfill, as described in U.S. Pat. No. 5,512,613, which is assigned to the present assignee, requires a cleaning process, which does not attack the C4 solder joints. Unfortunately, however, removal of the flux and flux products and cleaning of the solder is a difficult task because the cleaning process may itself be corrosive to the solder and/or electronic component. Additionally, dissolution of the solder can occur resulting in a smaller amount of solder forming the solder bond and cause disposal problems since the solders are generally lead/tin alloys and their solutions pose an environmental threat if discharged.

The solution to many of the problems evidenced in the '285 patent are achieved by a composition and method for cleaning solder to remove flux, flux reaction products, contaminants, residues from manufacturing operations, e.g., plating bath and photoresist residues and the like without any significant dissolution of the solder. The composition comprises a solution of a non-aromatic sulfonic acid and a substituted alcohol preferably a substituted aliphatic alcohol. The non-aromatic organic sulfonic acid is preferably methanesulfonic acid (MSA) and the alcohol 2,2,2-trifluoroethanol. The method of the '285 patent uses the above composition by applying the composition to the solder to be cleaned in any suitable way, e.g., by immersion in a bath at a temperature of about 25 to 75° C., or higher, preferably 50 to 70° C. for 1 to 120 minutes, preferably 5 to 60 minutes. Immersion may be performed under an inert cover (e.g., $N_2$) but this is apparently not necessary.

U.S. Pat. No. 6,250,318 describes the art of cleaning using conventional washing equipment. The equipment generally consists of multiple zones of treatment; namely, a wash zone, a rinse zone and a dry zone. The wash zone typically contains a prewash section, a wash section and an air isolation section. In addition, there is a rinse section that typically includes a first rinse section to wash away the chemical from the wash section, a rinse section, a final rinse section and an isolation section. The final drying section generally contains an air isolation section, and the heated air-dry section. A central exhaust system located at the top of the entire apparatus acts to extract fumes generated from the washing actions, which are extracted by the central exhaust blower external to the cleaning apparatus. There is also a conveyor transport system that runs across the entire length of the various zones of treatment. This conveyor carries the device to be cleaned and moves the devices through the various treatment zones for cleaning and drying. The patent mentions that conventional cleaning equipment in the art generally include commercial spray nozzles attached to a spray manifold or hose, and held across the path of the device to be washed and cleaned. These nozzles are usually very large and bulky in diameter and provide various types of spray cones and angles of discharge. When these nozzles are attached a cross the spray manifold or hose, they cannot achieve close pitching when attached in a straight line. Thus spray angle coverage is the only means by which these spray nozzles reach the entire surface of the devices to be cleaned. This spray angulation causes the edges of the devices to experience a decrease in fluid energy as in the decrease of mass momentum of fluid motion. Advancement in miniaturization of semiconductor chips with the creation of micro-ball grid area packages and chip scale packages has seen the input-output interconnect leads being replaced by solder balls, with a pitch of around 1.0 to 1.5 mm. With the bulky size of the spray nozzles, cleaning of such closely packed devices become ineffective.

U.S. Pat. No. 6,203,637 describes use of a cleaning process. During the so-called "packaging" of integrated circuits, several operations are distinguished which comprise a bonding of surfaces: 1. The individual integrated circuits are cut out of a silicon wafer and are applied to semiconductor system carriers and are bonded with these (so-called die bonding). The semiconductor system carrier surface is normally made of copper or of nickel, silver or gold or of a material on an epoxy basis, generally of a plastic material. Examples of such semiconductor system carriers are punched or etched metallic lead frames, ceramic substrates or ball grid array substrate carriers made of plastic. Hard soldering, soft soldering and gluing are used as bonding processes. In the case of flip chip solder processes, the integrated circuit is applied to a semiconductor system carrier by geometrically separated solder balls, which are simultaneously used as an I/O-bonding. 2. Bonding the integrated circuits with contact support points on the semiconductor system carrier, as, for example, on the lead frame. The participating surfaces are metallic, for example, of Al, Au, Cu, Ni, Pd. Here, soldering or welding, particularly flux-free soldering or ultrasonic welding, are used as bonding techniques. This step is known as wire bonding. 3. Molding: In this process step, the circuits are molded by a molding material on the semiconductor system carriers, for example, the lead frames, after the wire bonding, the above-mentioned surfaces of the semiconductor system carriers and the integrated circuits participating with respect to the molding material. This patent mentions as a solution to the bonding problem the recognition that if gas plasma cleaning processes can proceed in an atmosphere, preferably in a vacuum atmosphere, with activated hydrogen, this will always lead to a "conservation" of the surfaces with respect to air. In other words the invention even permits the storing of the surfaces after the "cleaning" and before their bonding, in air, without the occurrence of the disadvantages with respect to the capacity to be bonded.

Other patents to be mentioned include U.S. Pat. Nos. 5,532,094; 5,593,504; 5,821,208; 5,910,010; and 6,229,215.

To the best knowledge of the inventors herein, the discoloration of gold arrays on flip chip ball grid array (FCBGA) has not been publicly disclosed, and therefore, no cleaning methodologies have been proposed for this particular problem. While the root cause of the discoloration is still under investigation, the inventors herein believe that it results from surface contamination by organic and ionic species, which get transported from the back surface of the assembly to the front surface during a metrology step that involves immersion of the assemblies in an aqueous solution. FIG. 1 is a photograph of a discolored gold surface of a FCBGA assembly. As may be seen, the discoloration is in the form of circular spots or irregular patches, spread in an uneven fashion on the gold surface.

In a FCBGA, the solder bumped chip is placed face down onto matching wettable bonding pads on a multilayer BGA substrate. And the assembly is reflowed. The bonding pads on the substrate may initially be bare of any solder or may be solder bumped and coined prior to chip assembly. After flip chip attachment, the chip is under-filled with an epoxy resin formulated to relieve the stresses induced by the thermal mismatch between the chip and the substrate and to prevent moisture form getting to the chip surface. After chip assembly, an adhesive is applied to the top surface of the stiffener ring (typically made of copper), and the back of the chip is covered with a pliable conductive adhesive. A copper plate is attached to the stiffener ring, while the center of the plate is in contact with the adhesive on the back of the chip. The heat dissipated by the chip is thus conducted through the adhesive to the heat spreading copper plate. A heat sink can be attached to the plate to further lower the case to ambient air thermal resistance. The exposed metal surface finishes on the substrate may be electroplated or electroless plated with Ni/Au or coated with an organic surface preservative. After chip encapsulation, solder balls are attached to the underside of the substrate to complete the FCBGA. FIG. 2 is a cross-section of a typical FCBGA assembly.

In addition to the discoloration problem, it would be preferable if a cleaning methodology could be developed that avoids immersion and the use of chemicals that might have an adverse affect on the entire packaging that is often comprised of a variety of materials (ceramic, gold, copper, plastic and the like). Highly concentrated fluids and some organic solvents might be more able cleaners, but may be too aggressive and pose environmental and other regulatory risks. In addition, after the discoloration is removed, the chemical is preferably removable so that no residual chemical resides on the surface. From the above it is clear that there is currently no acceptable way to remove discoloration from metallic surfaces of BGA packages without the use of exotic plasmas and other means. It would be advantageous if methods could be provided which address the need for non-discolored ball grid array packages.

SUMMARY OF THE INVENTION

In accordance with the present invention, discoloration on exposed metal surfaces of ball grid array packaging and other electronic packages may be cleaned by a method comprising a combination of an organic cleaning step with an aqueous acidic chemical cleaning step, followed by thoroughly rinsing the cleaned surface with deionized water and preferably subsequent drying of the surface. The organic cleanup step removes nonionic residues and prepares the surface for the second cleaning step that involves acidic reagents for chemical dissolution of oxides, hydroxides and other species on the surface of the metal.

The inventive methods of removing discoloration from a metal surface (preferably gold, nickel, or alloy of gold and nickel) of an electronic device (preferably a FCBGA), comprise the steps of:

a) exposing a metallic surface of an electronic device to a first composition comprising an organic reagent (preferably high purity acetone diluted about 1 to about 10 times with deionized water), the metallic surface having discoloration thereon, under conditions sufficient to form a first intermediate metallic surface substantially devoid of non-ionic residues;

b) contacting the first intermediate metallic surface with a second composition comprising an acid (preferably hydrochloric acid diluted about 1 to about 50 times with deionized water) under conditions sufficient to form a second intermediate metallic surface substantially devoid of non-ionic residues, oxides, hydroxides and the like; and c) rinsing the second intermediate metallic surface with deionized water, the deionized water substantially devoid of organic compounds, under conditions sufficient to form a cleaned metallic surface substantially devoid of non-ionic residues, oxides, hydroxides, organic residues, the first composition and the second composition.

Preferably, the method further includes the step of drying the cleaned metallic surface employing either a contact drying method, a non-contact method, or combination thereof.

Preferably, said drying by non-contact method comprises contacting the integrated circuit flip-chip package with a gas selected from the group consisting of nitrogen, argon, helium, hydrogen, oxygen, a halogen, and mixtures thereof.

Preferably, said other means are selected from the group consisting of gas purging, heating, baking, vacuum, and combinations of same.

During steps a) and b), the conditions are sufficient ether to i) remove the residue; or ii) chemically modify the residue to form a modified residue that may be removed by other means, for example, the preferred rinsing and drying steps.

Another aspect of the invention is a method of removing discoloration from a metal surface (preferably gold, nickel, or alloy of gold and nickel) of a flip-chip ball grid array, the method comprising the steps of:

a) exposing a metallic surface of the flip-chip ball grid array to a first composition comprising high purity acetone diluted about 1 to about 10 times with deionized water, the metallic surface having discoloration thereon, under conditions sufficient to form a first intermediate metallic surface substantially devoid of non-ionic residues;

b) contacting the first intermediate metallic surface with a second composition comprising hydrochloric acid diluted about 1 to about 50 times with deionized water under conditions sufficient to form a second intermediate metallic surface substantially devoid of nonionic residues, oxides, hydroxides and the like; and c) rinsing the second intermediate metallic surface with deionized water, the deionized water substantially devoid of organic compounds, under conditions sufficient to form a cleaned metallic surface substantially devoid of non-ionic residues, oxides, hydroxides, organic residues, the first composition and the second composition; and d) drying the cleaned metallic surface employing a drying method selected from the group consisting of contact methods, non-contact methods, and combinations thereof.

Further understanding of the invention will be forthcoming after review of the description of preferred embodiments and claims that follow.

BRIEF DESCRIPTION OF THE DRAWING FIGURES

The patent or application file contains at least one drawing executed in color. Copies of this patent or patent application publication with color drawing(s) will be provided by the office upon request and payment of the necessary fee.

DESCRIPTION OF PREFERRED EMBODIMENTS

Figure 1:
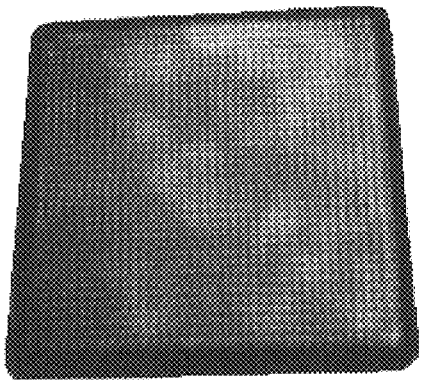
FIG. 1 is a photograph of a discolored metallic surface of a flip-chip ball grid array.
Figure 2:
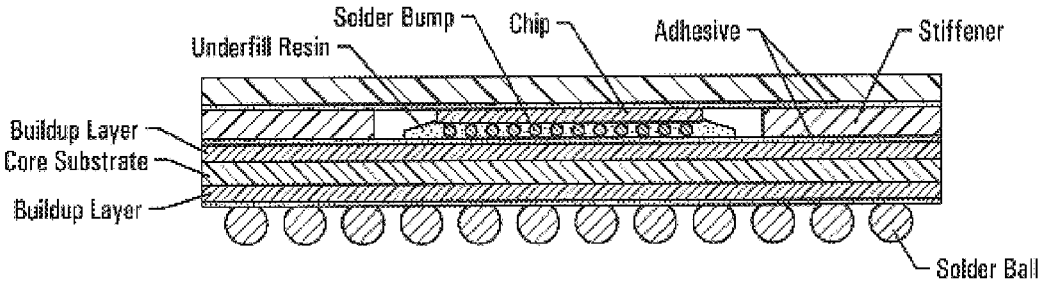
FIG. 2 is a side elevation cross-sectional view of a typical flip-chip ball grid array package.

The inventors herein have discovered that discoloration on exposed metallic surfaces, such as those found in flip chip ball grid arrays, may be cleaned to remove the discoloration using specific chemicals in specific sequential steps.

The first step of the inventive processes comprises the step of exposing a metallic surface of an electronic device to a first composition comprising an organic reagent. The first composition comprising an organic reagent functions to remove non-ionic residues from the metallic surface. Preferably, the organic reagent is selected from the group consisting of low molecular weight organic aldehydes, ketones and alcohols. Preferred aldehydes are selected from the group consisting of formaldehyde, propanal, 5-mthylhexanal, benzaldehyde, α-chloropropionaldehyde, β-bromobutyraldehyde, and the like. Preferred ketones are selected from the group consisting of acetone, methylethyl ketone, ethylethyl ketone, methylisopropyl ketone and the like. One particularly preferred ketone is acetone. Preferred alcohols are selected from the group consisting of methanol, ethanol, n-propyl alcohol, isopropyl alcohol, phenol and mixtures thereof. A particularly preferred alcohol is isopropyl alcohol. The organic reagent may be a mixture of two or more organic compounds, however, it is preferred that a single organic compound be used. The preferred organic reagent is high purity acetone, diluted about 1 to about 10 times with deionized water.

As used herein the term "high purity" means, when referenced to the inert gas the inert gas has less than 1 part per million total impurity (inorganic compounds and organic compounds). "Ultra-high-purity" as used herein when referenced to the inert gas means the inert gas has less than 1 part per billion total impurity (inorganic compounds and organic compounds).

The phrase "exposing a metallic surface . . . under conditions sufficient to form a first intermediate metallic surface substantially devoid of non-ionic residues" means that the exposure to the organic reagent occurs for a length of time ranging from about 10 seconds up to about 10 minutes, more preferably a time ranging from about 10 seconds up to about 1 minute, at a temperature ranging from about 1° C. up to and including the boiling temperature of the organic reagent at the pressure of application of the organic reagent. The upper temperature is also limited to the temperature at which the electronic component would suffer deformation, such as due to melting of metallic or plastic sub-components. The pressure preferably ranges from several atmospheres below atmospheric pressure up to just below a pressure that might affect the structural integrity of the electronic component being cleaned. In this vein, it is noted that previously known methods and apparatus for spaying, brushing, swabbing or otherwise applying liquid reagents to electronic and other components may be employed, such as those described in U.S. Pat. No. 6,250,318, incorporated herein by reference.

The phrase "substantially devoid of non-ionic residues" means that the first intermediate metallic surface has less than about 1 ppm total non-ionic residues, preferably less than about 1 ppb total non-ionic residues.

The second step of the inventive methods comprises contacting the first intermediate metallic surface with a second composition comprising an acid. The second composition comprising an acid functions to remove oxides, hydroxides, and like residues from the metallic surface. The acid is preferably an inorganic acid selected from the group consisting of hydrochloric acid, phosphoric acid, nitric acid, hydrofluoric acid, and mixtures thereof. The second composition comprising and acid may be a mixture of two or more inorganic compounds, however, it is preferred that a single inorganic compound be used. The preferred inorganic acid is high purity hydrochloric acid, diluted about 1 to about 50 times with deionized water.

The phrase "exposing a metallic surface . . . under conditions sufficient to form a second intermediate metallic surface substantially devoid of non-ionic residues, oxides, hydroxides, and the like" means that the exposure to the acid composition occurs for a length of time ranging from about 10 seconds up to about 10 minutes, more preferably a time ranging from about 10 seconds up to about 1 minute, at a temperature ranging from about 1° C. up to and including the boiling temperature of the acid composition at the pressure of application of the organic reagent. Of course, if a stronger or more concentrated version of acid is used, the exposure time will tend to be less, while if a diluted version is used the exposure time will tend to be longer. The temperature of this exposure step is similar to the temperature of the organic reagent exposure step, ranging from about 1° C. up to and including the boiling temperature of the acidic reagent. The upper temperature is also limited to the temperature at which the electronic component would suffer deformation, such as due to melting of metallic or plastic sub-components. The pressure preferably ranges from several atmospheres below atmospheric pressure up to just below a pressure that might affect the structural integrity of the electronic component being cleaned. In this vein, it is noted that previously known methods and apparatus for spaying, brushing, swabbing or otherwise applying liquid reagents to electronic and other components may be employed, such as those described in U.S. Pat. No. 6,250,318, previously incorporated herein by reference.

The phrase "substantially devoid of non-ionic residues, oxides, hydroxides and the like" means that the second intermediate metallic surface has less than about 10 ppm total non-ionic residues, oxides, hydroxides and the like, preferably less than about 1 ppm total non-ionic residues, oxides, hydroxides, and the like.

Finally, the phrase "substantially devoid of non-ionic residues, oxides, hydroxides, organic residues, the first composition and the second composition" means the cleaned metallic surface has less than about 1 ppm total non-ionic residues, oxides, hydroxides and the like, first composition and second composition, preferably less than about 1 ppb total non-ionic residues, oxides, hydroxides, and the like, first composition, and second composition.

The third step of the inventive processes comprises rinsing the second intermediate metallic surface with deionized water. The deionized water is substantially devoid of organic compounds, meaning in this case that the deionized water has less than 1 ppm organic compounds, more preferably less than 1 ppb carbon compounds. This step occurs under conditions sufficient to form a cleaned metallic surface substantially devoid of non-ionic residues, oxides, hydroxides, organic residues, the first composition and the second composition. The rinsing step functions to remove oxides, hydroxides, and like residues from the metallic surface, as well as substantially all remaining organic composition and acidic composition used in the first and second steps. Exposure to the deionized water occurs for a length of time ranging from about 10 seconds up to about 10 minutes, more preferably a time ranging from about 10 seconds up to about 1 minute, at a temperature ranging from about 1° C. up to and including the boiling temperature of the deionized water at the pressure of application of the deionized water. Of course, if a stronger or more concentrated version of acid is used in the previous step, the exposure time will tend to be longer, while if a diluted version of acid is used the exposure time to deionized will tend to be shorter. The temperature of this exposure step is similar to the temperature of the organic reagent exposure step and the acid composition exposure step, ranging from about 1° C. up to and including the boiling temperature of the deionized water at the pressure of application of the deionized water. The upper temperature is also limited to the temperature at which the electronic component would suffer deformation, such as due to melting of metallic or plastic sub-components. The pressure preferably ranges from several atmospheres below atmospheric pressure up to just below a pressure that might affect the structural integrity of the electronic component being cleaned.

A preferred, although not required step in all cases, is drying the cleaned metallic surface employing a drying method selected from the group consisting of contact methods, non-contact methods, and combinations thereof. This step is not considered necessary in the sense that it is not necessary to remove the discoloration. Whether the step is required depends on the electric component, the downstream use of the component, storage conditions after cleaning, the customer desires, and the like. For example, if the component is to be exposed to a dry atmosphere in storage, a separate drying step may not be necessary.

If necessary, contact drying may be accomplished by contacting the cleaned component with an absorbent material, for example drying between folds of a lint-free absorbent material. A non-contact method may be employed, such as blowing dry air or preferably a dry inert gas, preferably nitrogen, on the cleaned metallic surface. A combination of contact and non-contact drying methods may be employed. Preferably the inert gas is high purity, more preferably ultra-high-purity, as defined herein. As used herein the term "dry" means the gas preferably has a moisture content less than 10 percent relative humidity (RH), more preferably less than 1 percent RH. As used herein the term "high purity" means, when referenced to the inert gas the inert gas has less than 1 part per million total impurity (inorganic compounds and organic compounds). "Ultrahigh-purity" and "ultra pure" as used herein when referenced to the inert gas means the inert gas has less than a few parts per billion total impurity (inorganic compounds and organic compounds). Methods of making ultra pure inert gases may be used as taught in U.S. Pat. No. 6,047,561, incorporated herein by reference.

Figure 3:
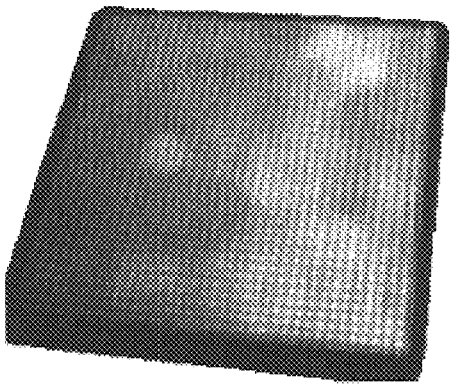
FIG. 3 is a photograph of a discolored gold surface of a flip-chip ball grid array before cleaning using one of the preferred methods of the invention.
Figure 4:
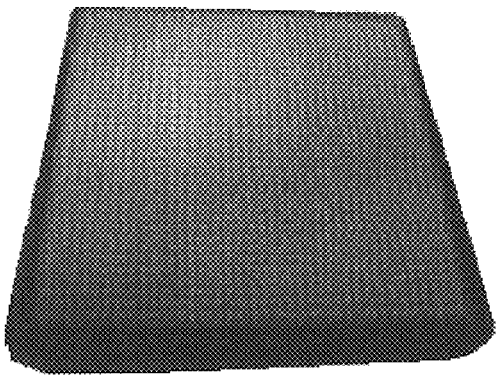
FIG. 4 is a photograph of a cleaned gold surface of the flip-chip ball grid array of FIG. 3 after cleaning using one of the preferred methods of the invention.

FIG. 3 is a photograph of a discolored gold surface of a flip-chip ball grid array before cleaning using one of the preferred methods of the invention, and FIG. 4 is a photograph of a cleaned gold surface of the flip-chip ball grid array of FIG. 3 after cleaning using one of the preferred methods of the invention. In this particular example, the first step comprised exposing the gold surface to a high purity, isopropyl alcohol solution. All exposure steps were performed at room temperature (about 25° C.) and at atmospheric pressure. The second exposure step employed hydrochloric acid. Finally, the component was rinsed with fresh deionized water, then dried between the folds of an absorbent material.

Although the description herein is intended to be representative of the invention, it is not intended to limit the scope of the appended claims.

What is claimed is:

1. A method of removing discoloration from a metal surface of an integrated circuit flip-chip package, the method comprising the steps of:

a) exposing a metallic surface of an integrated circuit flip-chip package to a first composition comprising an organic reagent, the metallic surface having discoloration thereon, said discoloration caused by the presence of non-ionic residues, oxides, hydroxides, and organic residues, under conditions sufficient to form a first intermediate metallic surface having less than 1 ppm total of said non-ionic residues;

b) contacting the first intermediate metallic surface with a second composition comprising an acid under conditions sufficient to form a second intermediate metallic surface having less than 10 ppm total of said non-ionic residues, oxides, and hydroxides; and c) rinsing the second intermediate metallic surface with deionized water, the deionized water having less than 1 ppm organic compounds, under conditions sufficient to form a cleaned metallic surface having less than 1 ppm total of said non-ionic residues, oxides, hydroxides, organic residues, the first composition and the second composition, and thereby removing said discoloration.

2. The method of claim 1 including the step of drying the cleaned metallic surface employing either a contact drying method, a non-contact method, or combination thereof.

3. The method of claim 1 wherein during steps a) and b), the conditions are sufficient to i) remove the remaining non-ionic residue; or ii) chemically modify the remaining non-ionic residue to form a modified residue that may be removed by other means.

4. The method of claim 1 wherein the organic reagent is acetone.

5. The method of claim 1 wherein the acid composition comprises hydrochloric acid.

6. The method of claim 1 wherein said metallic surface is selected from the group consisting of gold, nickel, and alloys of gold and nickel.

7. The method of claim 1 wherein said integrated circuit flip-chip package comprises solder ball connectors, said metallic surface contacting said solder ball connectors and having said discoloration in irregular patterns thereon.

8. The method of claim 2 wherein said drying by non-contact method comprises contacting the integrated circuit flip-chip package with a gas selected from the group consisting of nitrogen, argon, helium, hydrogen, oxygen, a halogen, and mixtures thereof.

9. The method of claim 3 wherein the other means are selected from the group consisting of gas purging, heating, baking, vacuum, and combinations of same.

10. The method of claim 4 wherein the acetone is diluted with about 1 to about 10 parts deionized water.

11. The method of claim 5 wherein the hydrochloric acid is diluted with about 1 to about 50 parts deionized water.

12. A method of removing discoloration from a metal surface of an integrated circuit flip-chip ball grid array, the method comprising the steps of:

(a) exposing a metallic surface of the integrated circuit flip-chip ball grid array to a first composition comprising acetone diluted about 1 to about 10 times with deionized water, the metallic surface having discoloration thereon, said discoloration caused by the presence of non-ionic residues, oxides, hydroxides, and organic residues, under conditions sufficient to form a first intermediate metallic surface having less than 1 ppm total of said non-ionic residues;

(b) contacting the first intermediate metallic surface with a second composition comprising hydrochloric acid diluted about 1 to about 50 times with deionized water under conditions sufficient to form a second intermediate metallic surface having less than 10 ppm total of said non-ionic residues, oxides, hydroxides;

(c) rinsing the second intermediate metallic surface with deionized water, the deionized water having less than 1 ppm organic compounds, under conditions sufficient to form a cleaned metallic surface having less than 1 ppm of said non-ionic residues, oxides, hydroxides, organic residues, the first composition and the second composition; and (d) drying the cleaned metallic surface employing a drying method selected from the group consisting of contact methods, non-contact methods, and combinations thereof, and thereby removing said discoloration.

* * * * *